US012497796B1

(12) United States Patent
Zhou

(10) Patent No.: US 12,497,796 B1
(45) Date of Patent: Dec. 16, 2025

(54) SIDEWAYS MOVEMENT METHOD FOR POOL CLEANING APPARATUS AND CORRESPONDING POOL CLEANING APPARATUS

(71) Applicant: AIPER GLOBAL PTE. LTD., Singapore (SG)

(72) Inventor: Jiyong Zhou, Shenzhen (CN)

(73) Assignee: AIPER GLOBAL PTE. LTD., Singapore (SG)

( * ) Notice: Subject to any disclaimer, the term of this patent is extended or adjusted under 35 U.S.C. 154(b) by 0 days.

(21) Appl. No.: 18/924,209

(22) Filed: Oct. 23, 2024

(30) Foreign Application Priority Data

Jun. 13, 2024 (CN) ..... 202410758460.4

(51) Int. Cl.
*E04H 4/16* (2006.01)

(52) U.S. Cl.
CPC ..... *E04H 4/1663* (2013.01); *E04H 4/1636* (2013.01); *E04H 4/1654* (2013.01)

(58) Field of Classification Search
CPC ..... E04H 4/16; E04H 4/1654; E04H 4/1636; E04H 4/1663
See application file for complete search history.

(56) References Cited

U.S. PATENT DOCUMENTS 9,222,275 B2 12/2015 Ben Dov
10,294,686 B1 * 5/2019 Erlich ..... B63H 11/107
12,031,351 B2 7/2024 McQeen et al.
12,221,196 B1 * 2/2025 Liu ..... B25J 3/00
2014/0230168 A1 8/2014 Ben Dov et al.
2017/0342733 A1 11/2017 Korenfeld
2017/0362845 A1 12/2017 Korenfeld
2021/0277679 A1 9/2021 McQueen
2022/0042336 A1 * 2/2022 Dallet ..... G05D 1/0016
2023/0279685 A1 * 9/2023 Wang ..... E04H 4/1654 15/1.7

FOREIGN PATENT DOCUMENTS

CN 116378478 A 7/2023

OTHER PUBLICATIONS

Australian Exam Report dated Feb. 28, 2025 in connection with Application No. 2025200637.
European Extended Search Report dated Jul. 22, 2025 in connection with Application No. 25156384.7.

* cited by examiner

*Primary Examiner* — Michael D Jennings
(74) *Attorney, Agent, or Firm* — Eschweiler & Potashnik, LLC; Ningjiao Zhang

(57) ABSTRACT

A method for a pool cleaning apparatus to move sideways and a corresponding pool cleaning apparatus. The method may include: if the condition for the pool cleaning apparatus to move sideways is satisfied, controlling the pool cleaning apparatus to enter a sideways movement operating mode, so that the pool cleaning apparatus moves towards one side, and in the sideways movement operating mode, controlling a discharging pump to provide a thrust to a side opposite the one side; in the sideways movement operating mode, controlling the pool cleaning apparatus to drive the driving wheels on both sides at a target rotational speed difference, so that the pool cleaning apparatus is tilted towards the one side.

17 Claims, 4 Drawing Sheets

SIDEWAYS MOVEMENT METHOD FOR POOL CLEANING APPARATUS AND CORRESPONDING POOL CLEANING APPARATUS

CROSS-REFERENCE

The present disclosure claims a benefit of, and priority to Chinese Patent Application No. 202410758460.4 filed on Jun. 13, 2024, the disclosure of which is hereby expressly incorporated by reference herein in its entirety.

TECHNICAL FIELD

The disclosure relates to the technical field of pool cleaning, in particular to a sideways movement method for a pool cleaning apparatus and a corresponding pool cleaning apparatus.

BACKGROUND

Most of suspended objects and dirt in a pool, such as a swimming pool, will be attached to a waterline at a sidewall of the pool. The existing pool cleaning apparatus incidentally cleans the waterline while cleaning the wall of the pool, and thus the waterline cannot be cleaned thoroughly. Furthermore, it is not only time-consuming for the existing pool cleaning apparatus to climb upwards and/or downwards continuously on the wall of the pool, but also the existing pool cleaning apparatus has a poor cleaning effect on the waterline.

SUMMARY

According to a first aspect of the present disclosure, there is proposed a method for a pool cleaning apparatus to move sideways, the method comprising: if the condition for the pool cleaning apparatus to move sideways is satisfied, controlling the pool cleaning apparatus to enter the sideways movement operating mode, so that the pool cleaning apparatus moves towards one side; in the sideways movement operating mode, controlling the discharging pump to provide a thrust to a side opposite the one side; in the sideways movement operating mode, controlling the pool cleaning apparatus to drive the driving wheels on both sides at a target rotational speed difference, so that the pool cleaning apparatus is tilted towards the one side.

According to a second aspect of the present disclosure, there is proposed a pool cleaning apparatus, which may include a detecting component configured to detect whether a condition for the pool cleaning apparatus to move sideways is satisfied, a discharging pump configured to discharge water on at least one side, driving wheels arranged on both sides of a body of the pool cleaning apparatus, and a control system, wherein the control system can control the pool cleaning apparatus to enter a sideways movement operating mode based on a detection result of the detecting component, so that the pool cleaning apparatus moves to one side; wherein, in the sideways movement operating mode, the control system controls the discharging pump to provide a thrust to an opposite side of the one side; and in the sideways movement operating mode, the control system controls the rotational speed difference of the driving wheels on both sides of the body of the pool cleaning apparatus so that the pool cleaning apparatus is tilted towards the one side.

LIST OF REFERENCE NUMERALS

11. First waterlogging sensor; 12. Second waterlogging sensor;
21. Left discharging pump; 22. Right discharging pump;
31. Left drive wheel; 32. Right drive wheel;
41. Left obstacle detecting sensor; 42. Right obstacle detecting sensor.

DETAILED DESCRIPTION

With reference to FIGS. 1 to 7, embodiments of the present disclosure will be described in detail. According to one aspect of the present disclosure, there is proposed a pool cleaning apparatus, which may include a detecting component configured to detect whether a condition for the pool cleaning apparatus to move sideways is satisfied, a power mechanism configured to control the pool cleaning apparatus to travel, a discharging mechanism configured to discharging water, and a control system. The pool cleaning apparatus proposed in the present disclosure can move sideways, such as moving along a waterline direction of a sidewall of the pool to clean the waterline of the sidewall, moving sideways at the stairs of the pool to clean the stairs, and moving sideways to bypass the obstacle.

As an example, the discharging mechanism can be discharging pumps 21 and 22 arranged along both sides of a longitudinal axis of a body of the pool cleaning apparatus respectively. It should be understood that the orientations of the discharging pumps 21 and 22 as illustrated in the Figures are not limited herein; instead, in other embodiments, the orientations of the discharging pumps can be arranged as required, such as in a direction perpendicular to the plane of the bottom of the body of the pool cleaning apparatus and upwards to the top of the body, etc. It can be understood that the discharging direction of the discharging pump can also be changed by the grids arranged on it. In this embodiment, the discharging pump can at least discharge water towards a side in a direction opposite a direction in which the pool cleaning apparatus moves sideways.

As an example, the power mechanism may be a driving wheel(s), and both sides of the pool cleaning apparatus are respectively provided with at least one driving wheel. In this embodiment, the number of driving wheels 31 and 32 is two. In other embodiments, it is also feasible to arrange the crawler components as the power mechanism on both sides of the pool cleaning apparatus.

The detecting component configured to detect whether a condition for the pool cleaning apparatus to move sideways is satisfied can be a variety of different components to detect whether a condition for the pool cleaning apparatus to move sideways is satisfied.

The control system can be configured to control the pool cleaning apparatus to enter the sideways movement operating mode based on a detection result of the detecting component, so that the pool cleaning apparatus can move to one side.

Figure 1:
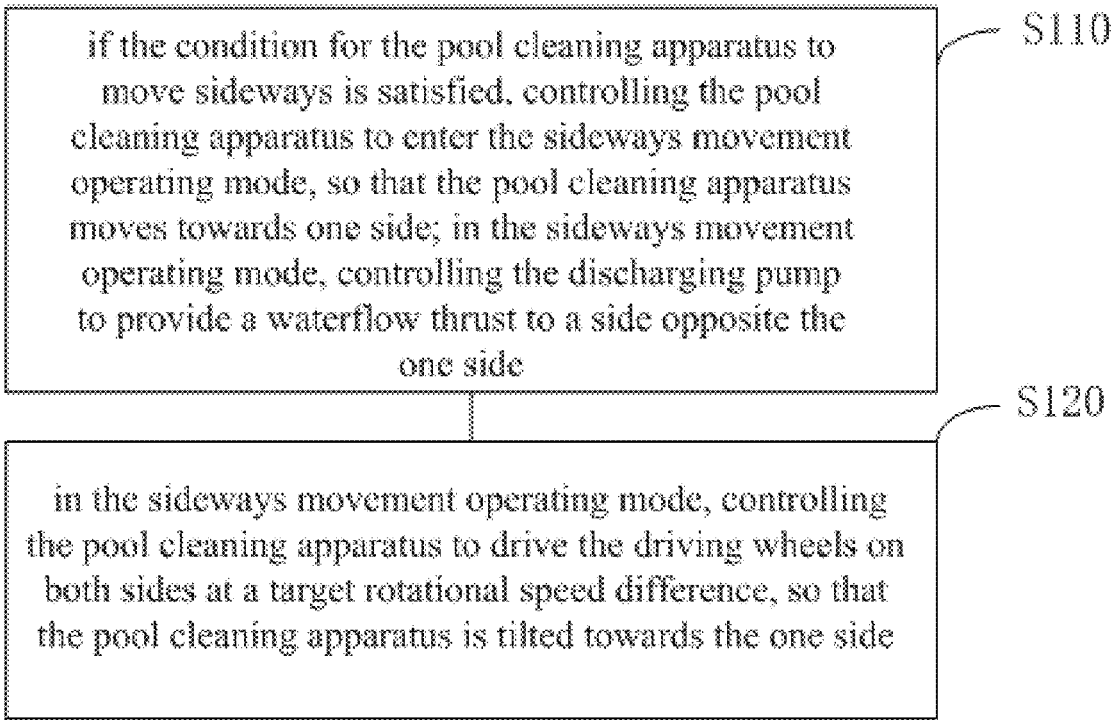
FIG. 1 is a schematic flowchart of a sideways movement method for a pool cleaning apparatus according to an embodiment of the present disclosure.

According to an embodiment of the present disclosure, the sideways movement method for a pool cleaning apparatus, as illustrated in FIG. 1, may include the followings:

S110, if the condition for the pool cleaning apparatus to move sideways is satisfied, controlling the pool cleaning apparatus to enter the sideways movement operating mode, so that the pool cleaning apparatus moves towards one side; in the sideways movement operating mode, controlling the discharging pump to provide a thrust to a side opposite the one side;

S120, in the sideways movement operating mode, controlling the pool cleaning apparatus to drive the driving wheels on both sides at a target rotational speed difference, so that the pool cleaning apparatus is tilted towards the one side.

It should be understood that the two steps of the sideways movement method of pool cleaning apparatus can be carried out simultaneously or in sequence, and the order of the two steps is not limited.

As an example, the condition for the pool cleaning apparatus to move sideways being satisfied can comprise at least one of the following: the pool cleaning apparatus being within a preset range of the waterline, the pool cleaning apparatus arriving at a predetermined location, the pool cleaning apparatus detecting an obstacle, the pool cleaning apparatus receiving a specific task, or the like.

As an example, the condition for the pool cleaning apparatus to move sideways being satisfied is that the pool cleaning apparatus is within the preset range of the waterline, the detecting component configured to detect whether a condition for the pool cleaning apparatus to move sideways is satisfied can be a water detecting component, which can detect whether a part of the pool cleaning apparatus is beyond the water surface, and can be a waterlogging sensor(s) 11, 12. In other embodiments, the water detecting component can be a Hall sensor, a power detection module for detecting the motor power of the discharging pump, which indicates that the pool cleaning apparatus is within the preset range of the waterline if the motor power of the discharging pump is within a preset range, or any sensors which can detect whether a part of the pool cleaning apparatus is beyond the water surface.

As an example, the condition for the pool cleaning apparatus to move sideways being satisfied can also be that the pool cleaning apparatus arrives at a predetermined location, which can include the pool cleaning apparatus being at stairs of the pool, or at the junction of the wall of the pool and the bottom of the pool, or at any location where the sideways movement may be needed.

As an example, the condition for the pool cleaning apparatus to move sideways being satisfied can also be that the pool cleaning apparatus detects an obstacle, wherein the pool cleaning apparatus moves sideways to bypass the obstacle upon detecting the obstacle.

As an example, the condition for the pool cleaning apparatus to move sideways being satisfied can also be that the pool cleaning apparatus receives a specific task, wherein the specific task can be a sideways movement instruction from a user or any instruction that requires sideways movement.

Figure 2:
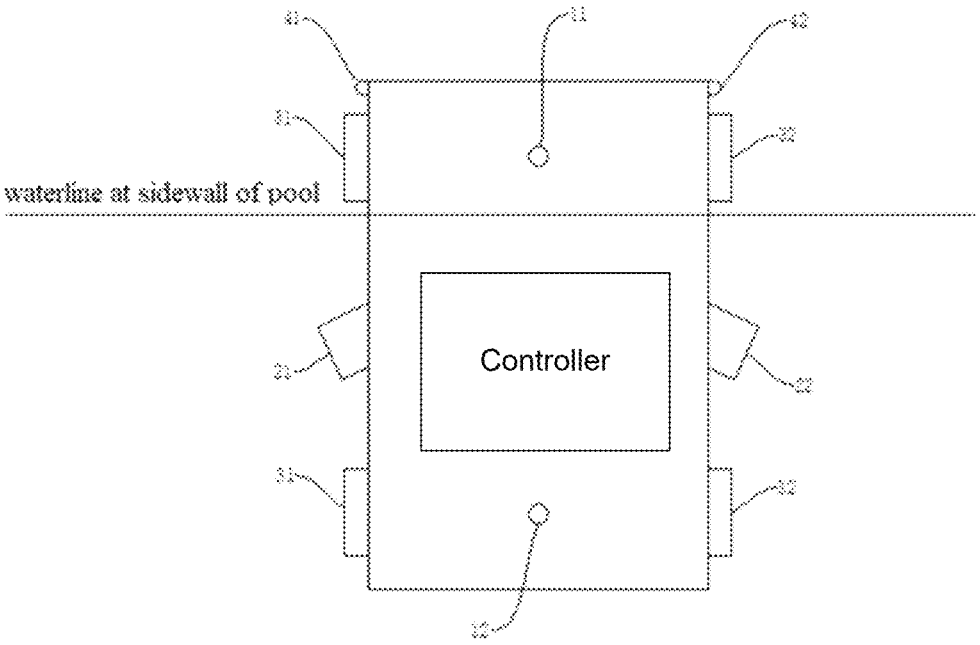
FIG. 2 is a front view of a pool cleaning apparatus according to an embodiment of the present disclosure.

In one embodiment, as illustrated in FIG. 2, the pool cleaning apparatus includes two waterlogging sensors, wherein the first waterlogging sensor 11 is located in a first half of the body of the pool cleaning apparatus, and the second waterlogging sensor 12 is located in a second half of the body of the pool cleaning apparatus. If the first waterlogging sensor 11 does not contact with the water and the second waterlogging sensor 12 contacts with the water, a signal is triggered, and in such a case, it is considered that the pool cleaning apparatus is within the preset range of the waterline, and the pool cleaning apparatus begins to move sideways to clean the waterline.

It can be understood that in other embodiments, the number of waterlogging sensors can be one, and the pool cleaning apparatus can determine whether a part of the pool cleaning apparatus is beyond the water surface or not based on a signal triggered by the waterlogging sensor. Other signals from the pool cleaning apparatus, such as the signal(s) involving the pump power, the traveling speed, the location of the pool cleaning apparatus, etc., can also be used as auxiliary factors to determine whether a part of the pool cleaning apparatus is beyond the water surface or not.

As an example, detecting the obstacle by the pool cleaning apparatus may include: acquiring the sensing information of an obstacle detecting component; determining whether the pool cleaning apparatus is close to an obstacle according to the sensing information of the obstacle detecting component. Optionally, the obstacle detecting component is an infrared sensor, a peripheral trigger or other means that can detect whether there exists an obstacle ahead.

As an example, the driving wheels on both sides of the pool cleaning apparatus have the target rotational speed difference so that the forces applied to the body of the pool cleaning apparatus are balanced, and thus the pool cleaning apparatus remains tilted at the waterline. The angle in which the pool cleaning apparatus is tilted to one side may be based on at least one of the shape of the pool cleaning apparatus, the weight thereof, the wall conditions of the pool, the driving power of the driving wheels or the preset cleaning efficiency.

Figure 5:
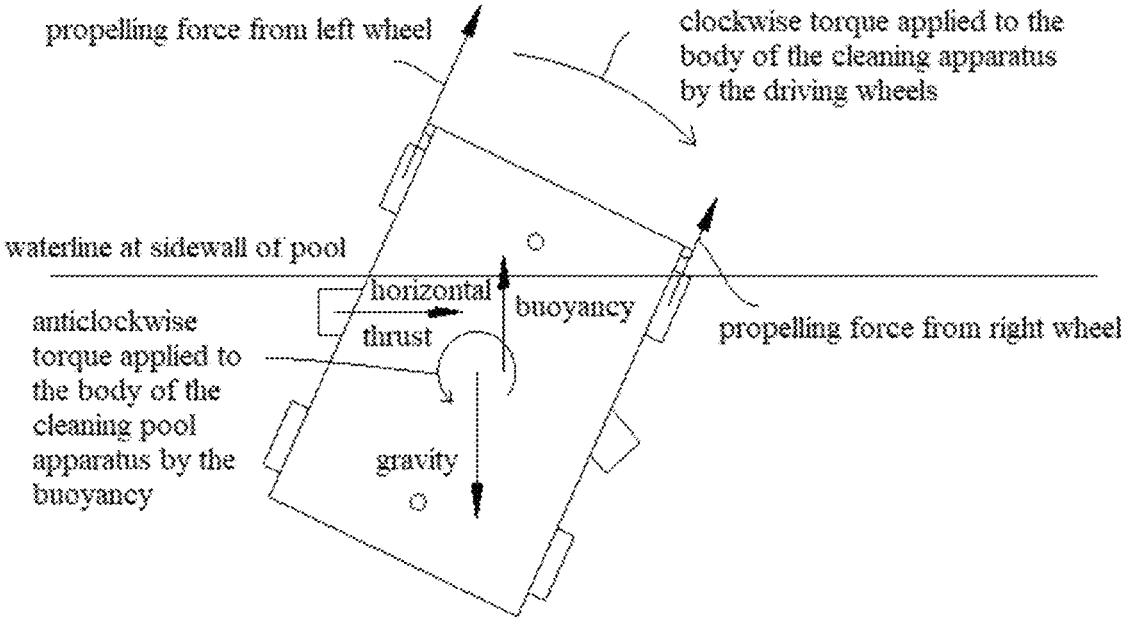
FIG. 5 is a schematic diagram illustrating the forces applied to the pool cleaning apparatus according to an embodiment of the disclosure.
Figure 7:
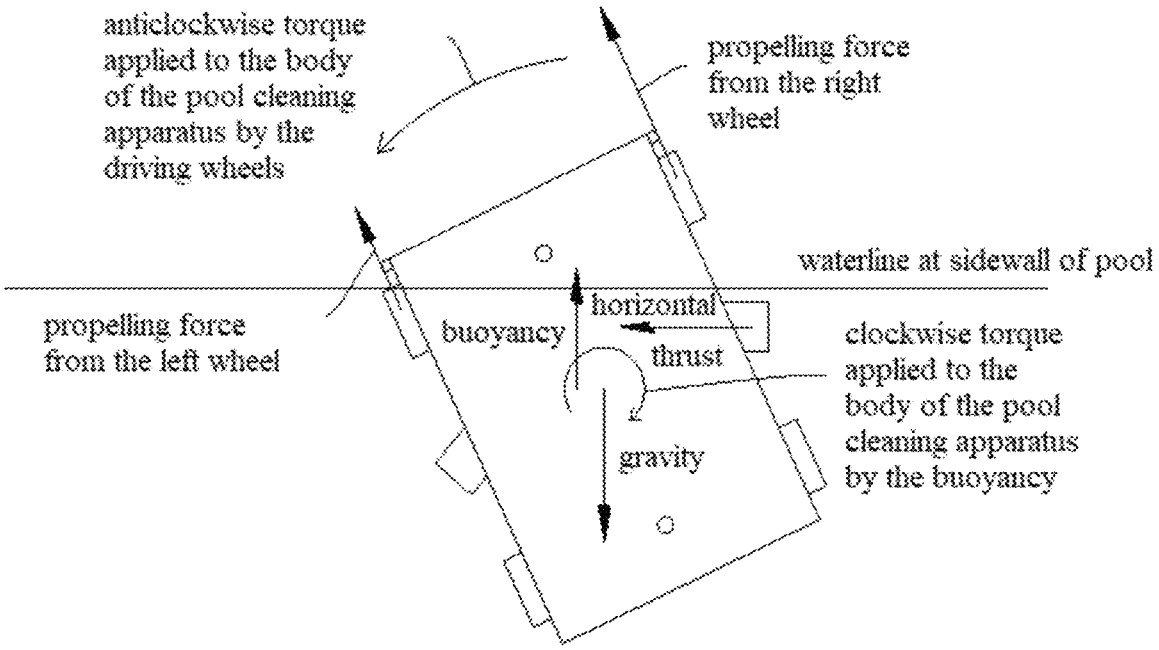
FIG. 7 is another schematic diagram illustrating the forces applied to the pool cleaning apparatus according to an embodiment of the disclosure.

As an example, in the viewing angle perpendicular to the wall of the pool, as illustrated in FIG. 5, if the rotational speed of the left driving wheel 31 of the pool cleaning apparatus is higher than that of the right driving wheel 32 of the pool cleaning apparatus, a clockwise torque is applied to the body of the pool cleaning apparatus due to the rotational speed difference of the driving wheels on both sides of the pool cleaning apparatus, causing the pool cleaning apparatus to be tilted to the right; in the case in which the pool cleaning apparatus is tilted to the right, the buoyancy applied to the body of the pool cleaning apparatus will move to the right for a certain distance from the center of gravity of the pool cleaning apparatus. The buoyancy is vertically upward, and the point at which the buoyancy is applied is located on the right side of the center of gravity, so in the case in which the pool cleaning apparatus is tilted to the right, an anticlockwise torque is applied to the body of the pool cleaning apparatus by the buoyancy. Similarly, as illustrated in FIG. 7, if the rotational speed of the driving wheel 32 on the right side of the pool cleaning apparatus is higher than that of the driving wheel 31 on the left side of the pool cleaning apparatus, an anticlockwise torque is applied to the body of the pool cleaning apparatus due to the rotational speed difference of the driving wheels on both sides of the pool cleaning apparatus, causing the pool cleaning apparatus to be tilted to the left; in the case in which the pool cleaning apparatus is tilted to the left, the buoyancy applied to the body of the pool cleaning apparatus will move to the left for a certain distance from the center of gravity of the pool cleaning apparatus. The buoyancy is vertically upward, and the point at which the buoyancy is applied is located on the left side of the center of gravity, so in the case in which the pool cleaning apparatus is tilted to the left, a clockwise torque is applied to the body of the pool cleaning apparatus by the buoyancy. If the pool cleaning apparatus is tilted in a preset angle so that the torque exerted by the driving wheels on the pool cleaning apparatus and that exerted by buoyancy are equal to each other and in opposite directions, the pool cleaning apparatus can be kept at the waterline in the preset angle. It is easy to understand that the pool cleaning apparatus can be kept tilt in a preset angle by the rotational speed difference of the driving wheels located at both sides of the pool cleaning apparatus, thus adjusting the orientation and angle of the pool cleaning apparatus conveniently, without moving the pool cleaning apparatus repeatedly.

When the pool cleaning apparatus is tilted to one side in a preset angle, the power of at least one discharging pump of the pool cleaning apparatus can be changed. It can be understood that a force component in a direction parallel to the horizontal plane can be generated due to the discharging water of the discharging pump, and the force component can move the pool cleaning apparatus sideways along the waterline. The sideways movement has no direct relevance to the driving wheels, and the sideways movement along the waterline can be performed in a sideways movement operating mode of the pool cleaning apparatus. In the sideways movement operating mode of the pool cleaning apparatus, the discharging pump(s) can be controlled by at least one of increasing the power of the first discharging pump, decreasing the power of the second discharging pump, or turning off the second discharging pump. Optionally, the way for controlling the discharging pump(s) can be selected based on the actual needs.

Figure 3A:
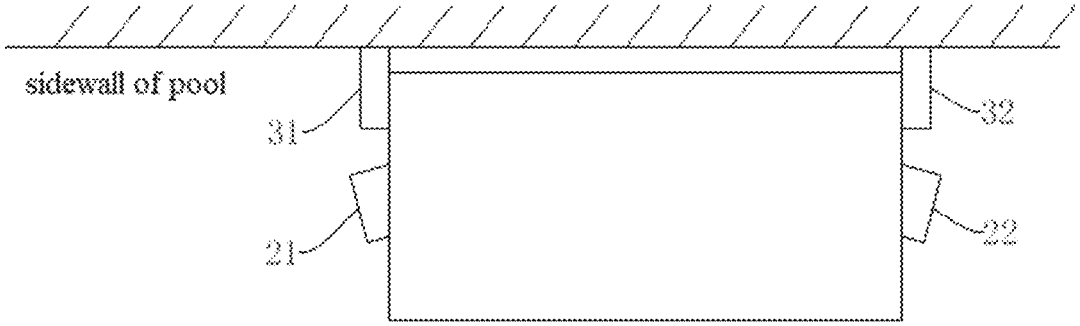
FIGS. 3A-3B are top views of a pool cleaning apparatus according to an embodiment of the present disclosure.
Figure 3B:
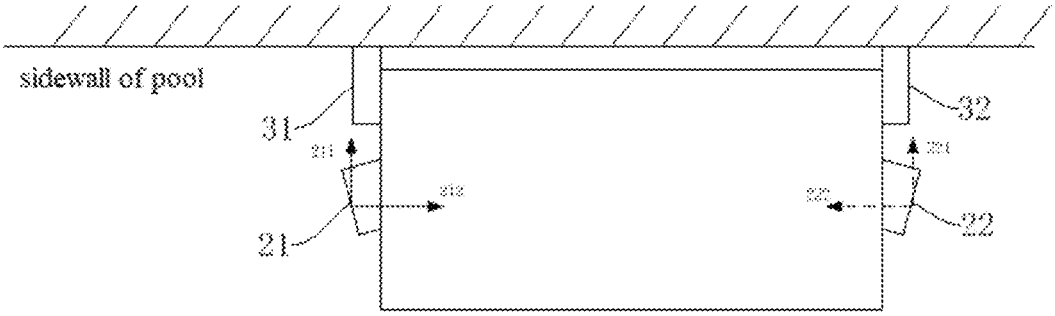

For example, both sides of the pool cleaning apparatus are respectively provided with a left discharging pump 21 and a right discharging pump 22. The orientation of the discharging pump(s) as illustrated is for reference only. In one embodiment, in a viewing angle perpendicular to the wall of the pool as illustrated in FIG. 2, when the longitudinal axis direction of the body of the pool cleaning apparatus is perpendicular to the waterline direction of the wall of the pool, the projection of the orientation of the left discharging pump 21 on the plane of the wall of the pool deviates from the longitudinal axis direction of the body of the pool cleaning apparatus a preset angle to the lower left, and the projection of the orientation of the right discharging pump 22 on the plane of the wall of the pool deviates from the longitudinal axis direction of the body of the pool cleaning apparatus a preset angle to the lower right. As illustrated in FIG. 3A, in the top viewing angle perpendicular to the water surface of the pool, the projection of the orientation of the left discharging pump 21 of the pool cleaning apparatus on the plane of the water surface of the pool is in a lower left direction, that is, in the left direction which is away from the wall of the pool; and the projection of the orientation of the right discharging pump 22 of the pool cleaning apparatus on the plane of the water surface of the pool is in a lower right direction, that is, in the right direction which is away from the wall of the pool. As illustrated in FIG. 3B, since the projection of the discharging direction of the left discharging pump 21 of the pool cleaning apparatus on the plane of the water surface of the pool is in the left direction which is away from the wall of the pool and has an angle deviating from the longitudinal axis direction of the body of the pool cleaning apparatus, a vertical thrust 211 perpendicular to and towards the wall of the pool and a horizontal thrust 212 parallel to the wall of the pool and towards to the right can be generated by the discharging via the left discharging pump 21; Similarly, since the projection of the discharging direction of the right discharging pump 22 of the pool cleaning apparatus on the plane of the water surface of the pool is in the right direction which is away from the wall of the pool and has an angle deviating from the longitudinal axis direction of the body of the pool cleaning apparatus, a vertical thrust 221 perpendicular to and towards the wall of the pool and a horizontal thrust 222 parallel to the wall of the pool and towards to the left can be generated by the discharging via the right discharging pump 22.

Figure 4:
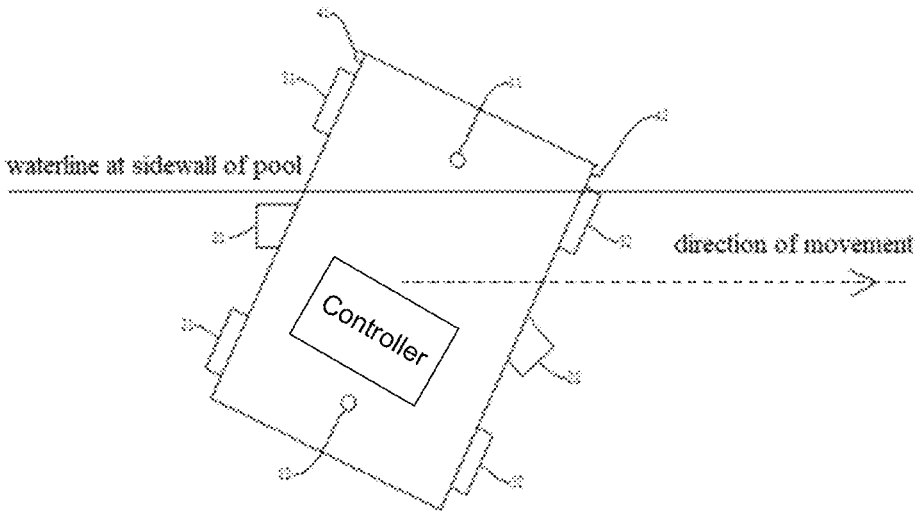
FIG. 4 is a schematic diagram illustrating the pool cleaning apparatus cleans the waterline in a direction according to an embodiment of the present disclosure.

As illustrated in FIG. 4 and FIG. 5, when it is required that the pool cleaning apparatus moves sideways to the right to clean the waterline, the rotational speed of the left driving wheel 31 of the pool cleaning apparatus is controlled to be higher than that of the right driving wheel 32, so that the pool cleaning apparatus is tilted to the right in a preset angle. As the discharging of the left discharging pump 21 of the pool cleaning apparatus generates a horizontal thrust 212 parallel to the wall of the pool and towards the right, the horizontal thrust to the right is applied to the body of the pool cleaning apparatus. In such a case, if the power of at least one discharging pump is changed, such as decreasing the power of the right discharging pump 22 or turning off the right discharging pump 22, the horizontal thrust exerted by the left discharging pump 21 on the body of the pool cleaning apparatus will propel the pool cleaning apparatus to move sideways to the right along the waterline.

Figure 6:
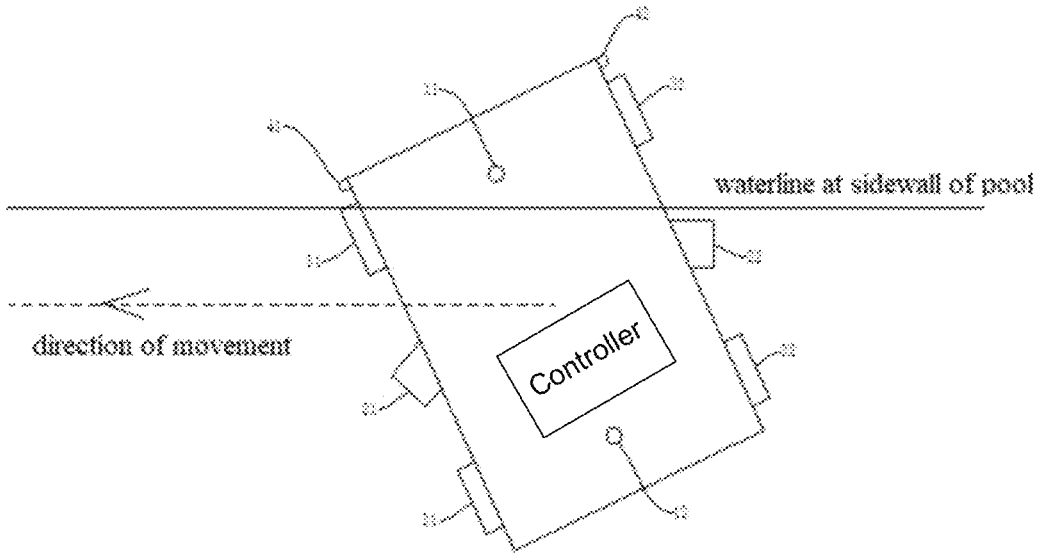
FIG. 6 is a schematic diagram illustrating the pool cleaning apparatus cleans the waterline in another direction according to an embodiment of the present disclosure.

Similarly, as illustrated in FIGS. 6 and 7, when it is required that the pool cleaning apparatus moves sideways to the left to clean the waterline, the rotational speed of the right driving wheel 32 of the pool cleaning apparatus is controlled to be higher than that of the left driving wheel 31, so that the pool cleaning apparatus is tilted to the left in a preset angle. As the discharging of the right discharging pump 22 of the pool cleaning apparatus generates a horizontal thrust 222 parallel to the wall of the pool and towards the left, a horizontal thrust to the left is applied to the body of the pool cleaning apparatus. In such a case, if the power of at least one discharging pump is changed, such as decreasing the power of the left discharging pump 21 or turning off the left discharging pump 21, the thrust exerted by the right discharging pump 22 on the body of the pool cleaning apparatus will propel the pool cleaning apparatus to move sideways to the left along the waterline.

In addition, as mentioned above, the discharging of the left discharging pump 21 on the left side of the pool cleaning apparatus can also generate a vertical thrust 211 perpendicular to and towards the wall of the pool, thereby applying a vertical thrust 211 towards the wall of the pool to the pool cleaning apparatus; In addition, the discharging of the discharging pump 22 on the right side of the pool cleaning apparatus can also generate a vertical thrust 221 perpendicular to and towards the wall of the pool, thus applying a vertical thrust 221 towards the wall of the pool to the pool cleaning apparatus; the vertical thrusts 221, 211 applied to the pool cleaning apparatus toward the wall of the pool can keep at least one of the driving wheels 31, 32 of the pool cleaning apparatus contact with the wall of the pool. In one embodiment, in order to keep the pool cleaning apparatus in a tilted posture during the sideways movement, the sideways movement method for the pool cleaning apparatus may further include controlling the rotational speed difference of driving wheels at both sides of the pool cleaning apparatus during the sideways movement to maintain the tilted angle of the pool cleaning apparatus within a predetermined range.

As an example, the pool cleaning apparatus may further include a gyroscope. The angle in which the pool cleaning apparatus is tilted relative to the upward direction perpendicular to the water surface can be detected by the gyroscope. For example, a preset angle range is within 5 to 30 degrees deviating from the upward direction perpendicular to the water surface, and if the angle of the pool cleaning apparatus, which deviates from the upward direction perpendicular to the water surface, detected by the gyroscope is 31 degrees, which indicates that the angle in which the pool cleaning apparatus is tilted is too large, and thus an angle adjustment is triggered. By controlling the left and right driving wheels, the rotational speed of the left and right driving wheels can be adjusted respectively, so that the angle adjustment can be realized, thus controlling the pool cleaning apparatus to be tilted in a specific angle. The orientation and/or angle of the pool cleaning apparatus can be adjusted in real time by the gyroscope to meet the work requirements.

In an embodiment, during the sideways movement, if the posture of the pool cleaning apparatus is detected as abnormal, the pool cleaning apparatus can perform corresponding actions to adjust the posture or stop the sideways movement. The abnormal posture of pool cleaning apparatus can be detected through the data from an accelerometer, an Inertial Measurement Unit IMU, or a position sensor. For example, if the value detected by the accelerometer of the pool cleaning apparatus in the Y-axis direction increases in the state of climbing the wall of the pool, it means that the posture of the pool cleaning apparatus is in abnormal and the pool cleaning apparatus is in the state of not contacting with the wall. In such a case, the pool cleaning apparatus turns off the discharging pump and sinks, and then randomly climbs the wall to continue cleaning the waterline or sidewall of the pool after the pool cleaning apparatus falls to the bottom of the pool.

As an example, the sideways movement method for the pool cleaning apparatus may further include controlling the pool cleaning apparatus to move backward upon a preset condition for the sideways movement of the pool cleaning apparatus being satisfied. The preset condition may include at least one of the followings: moving for a predetermined time period or a predetermined distance, or detecting that the pool cleaning apparatus arrives at a destination of the sideways movement. Optionally, when the pool cleaning apparatus moves sideways, the pool cleaning apparatus cleans the waterline at the sidewall of the pool. Optionally, the destination of the sideways movement can be an end of the waterline of the sidewall of the pool.

As an example, moving the pool cleaning apparatus sideways for a predetermined time period may include obtaining the time information on the sideways movement of the pool cleaning apparatus along the waterline and determining whether the pool cleaning apparatus moves sideways along the waterline for a preset time period. For example, a timing module is arranged within the pool cleaning apparatus, and when the timing module indicates a preset time period is expired, a signal indicating that the pool cleaning apparatus climbs down the sidewall of the pool is sent to the control system of the pool cleaning apparatus, so that the control system controls the pool cleaning apparatus to end the waterline cleaning process.

As an example, controlling the pool cleaning apparatus to move backward may include controlling the pool cleaning apparatus to enter a backward movement operating mode, so that the pool cleaning apparatus moves backward to the bottom of the pool along the wall of the pool, wherein in the backward movement operating mode, the thrusts generated by the discharging of the discharging pump along both sides of the longitudinal axis of the body of the pool cleaning apparatus is substantially balanced.

As an example, controlling the pool cleaning apparatus to move backward may include controlling the pool cleaning apparatus to drive the driving wheels on both sides at the same rotational speed in the backward movement operating mode.

In summary, the sideways movement method for the pool cleaning apparatus provided by the present disclosure can include: if the condition for the pool cleaning apparatus to move sideways is satisfied, changing the operating mode of the pool cleaning apparatus, so that the pool cleaning apparatus moves sideways to one side, wherein at least a thrust to be applied to an opposite side of the one side can be generated by the discharging of the discharging pump; controlling the pool cleaning apparatus to drive the driving wheels on both sides with a target rotational speed difference, so that the pool cleaning apparatus is tilted to the one side. By the sideways movement method for the pool cleaning apparatus, the pool cleaning apparatus can move sideways along the waterline of the wall of the pool and clean the waterline of the wall of the pool thoroughly, even the waterline at the corner of the wall of the pool. Moreover, the pool cleaning apparatus moves along the waterline in a tilted posture, which can increase the coverage of the cleaning roller of the pool cleaning apparatus in the area near the waterline, thus improving the cleaning efficiency.

It should be noted that the concept of that present disclosure is not limit to moving the pool cleaning apparatus sideways along the waterline to clean the waterline. Optionally, the sideways movement may be beneficial when the pool cleaning apparatus is in contact with a generally horizontal surface (e.g., the bottom of the pool) or some other angled surface or wall or stairs. In fact, the sideways movement can also assist the pool cleaning apparatus to bypass obstacles protruding from the surface on which it travels, or assist, for example, to efficiently remove debris found near the routine forward or backward travel path of the pool cleaning apparatus. The periodic or irregular sideways movement of the pool cleaning apparatus can also assist the pool cleaning apparatus to get out of the trap, so as to reduce the possibility that the pool cleaning apparatus gets stuck in the corner of the wall of the pool.

According to the embodiments of the present disclosure, the pool cleaning apparatus can move sideways along the waterline of the wall of the pool, and can clean the waterline, the stairs of the pool and/or bypass the obstacles, so that the pool cleaning apparatus can move in the horizontal direction, clean the pool thoroughly without leaving dead angles. In addition, the pool cleaning apparatus moves along the waterline in an inclined posture and clean the waterline at the same time, increasing the coverage area of the cleaning roller of the pool cleaning apparatus in the area near the waterline, and improving the cleaning effect.

The above only illustrates the embodiments of the present disclosure, and it does not limit the protection scope of the disclosure. All equivalences made based on the contents of the disclosure and directly or indirectly applied to related technical fields, can be included in the protection scope of this disclosure.

What is claimed is:

1. A sideways movement method for a pool cleaning apparatus, comprising:

in response to a condition for the pool cleaning apparatus to move sideways is satisfied, controlling a discharging pump and driving wheels arranged on both sides of a body of the pool cleaning apparatus to enter a sideways movement operating mode, so that the pool cleaning apparatus moves towards one side; wherein the condition comprises at least one of the pool cleaning apparatus being within a preset range of a waterline, the pool cleaning apparatus arriving at a predetermined location, the pool cleaning apparatus detecting an obstacle, or the pool cleaning apparatus receiving a specific task, wherein in the sideways movement operating mode, the discharging pump is controlled to provide a thrust to a side opposite the one side, and the driving wheels are driven at a target rotational speed difference so that the pool cleaning apparatus is tilted towards the one side;

wherein during the sideways movement operating mode, in response to a posture of the pool cleaning apparatus being detected as abnormal, the method further comprises:

adjusting the posture of the pool cleaning apparatus, stopping sideways movement of the pool cleaning apparatus, controlling the pool cleaning apparatus to climb down a sidewall of a pool, or turning off the discharging pump of the pool cleaning apparatus.

2. The sideways movement method according to claim 1, wherein the pool cleaning apparatus being in the preset range of the waterline, comprises at least one of a part of the pool cleaning apparatus being detected as beyond a water surface by a water detecting component, or a motor power of the discharging pump of the pool cleaning apparatus being detected as in the preset range.

3. The sideways movement method according to claim 1, wherein the pool cleaning apparatus arriving at the predetermined location comprises at least one of the pool cleaning apparatus being located at stairs or at a junction of a wall and a bottom of a pool.

4. The sideways movement method according to claim 1, wherein if the pool cleaning apparatus detects the obstacle, the pool cleaning apparatus is controlled to move sideways to bypass the obstacle.

5. The sideways movement method according to claim 1, wherein the pool cleaning apparatus receiving the specific task comprises receiving a sideways movement instruction from a user.

6. The sideways movement method according to claim 1, wherein the target rotational speed difference makes forces applied to the body of the pool cleaning apparatus balanced and the body of the pool cleaning apparatus remain tilted at a waterline.

7. The sideways movement method according to claim 1, wherein the pool cleaning apparatus is tilted toward the one side in an angle, and the angle is based on at least one of a shape of the pool cleaning apparatus, weight of the pool cleaning apparatus, wall conditions of a pool, driving power of the driving wheels, or a preset cleaning efficiency.

8. The sideways movement method according to claim 1, wherein an angle in which the pool cleaning apparatus is tilted toward the one side is within a predetermined range.

9. The sideways movement method according to claim 1, wherein controlling the discharging pump to enter the sideways movement operating mode comprises controlling the discharging pump by at least one of increasing power of a first discharging pump, decreasing power of a second discharging pump, or turning off the second discharging pump.

10. The sideways movement method according to claim 1, further comprising: controlling the pool cleaning apparatus to move backward upon a preset condition for the sideways movement of the pool cleaning apparatus being satisfied.

11. The sideways movement method according to claim 10, wherein the preset condition comprises at least one of moving sideways for a predetermined time period or a predetermined distance, or the pool cleaning apparatus detecting an arrival at a destination by the sideway movement.

12. The sideways movement method according to claim 11, wherein during the sideways movement, the pool cleaning apparatus cleans a waterline of a sidewall of a pool, and the destination of the sideways movement is an end of the waterline of the sidewall.

13. The sideways movement method according to claim 10, wherein controlling the pool cleaning apparatus to move backward comprises controlling the pool cleaning apparatus to enter a backward movement operating mode, so that the pool cleaning apparatus moves backward along a wall of a pool and towards a bottom of the pool.

14. The sideways movement method according to claim 13, wherein in the backward movement operating mode, thrusts provided by discharging pumps along both sides of a longitudinal axis of the body of the pool cleaning apparatus are basically balanced.

15. The sideways movement method according to claim 13, wherein in the backward movement operating mode, the pool cleaning apparatus is controlled to drive the driving wheels on both sides at a same rotational speed.

16. The sideways movement method according to claim 1, wherein the posture of the pool cleaning apparatus is obtained through data from at least one of an accelerometer, an Inertial Measurement Unit, IMU, or a position sensor.

17. A pool cleaning apparatus comprising:

at least one sensor configured to detect whether a condition for the pool cleaning apparatus to move sideways is satisfied, wherein the condition comprises at least one of the pool cleaning apparatus being within a preset range of a waterline, the pool cleaning apparatus arriving at a predetermined location, the pool cleaning apparatus detecting an obstacle, or the pool cleaning apparatus receiving a specific task;

a discharging pump configured to discharge water on at least one side;

driving wheels arranged on both sides of a body of the pool cleaning apparatus; and a controller comprising hardware, the controller being configured to control the discharging pump and the driving wheels to enter a sideways movement operating mode based on a detection result of the at least one sensor, so that the pool cleaning apparatus moves to one side, wherein, in the sideways movement operating mode, the discharging pump is controlled to provide a thrust to an opposite side of the one side, and the driving wheels are driven at a rotational speed difference so that the pool cleaning apparatus is tilted towards the one side;

wherein during the sideways movement operating mode, in response to a posture of the pool cleaning apparatus being detected as abnormal, the controller is further configured to adjust the posture of the pool cleaning apparatus, stop sideways movement of the pool cleaning apparatus, control the pool cleaning apparatus to climb down a sidewall of a pool, or turn off the discharging pump of the pool cleaning apparatus.

* * * * *